United States Patent [19]

Fougea

[11] 4,251,059

[45] Feb. 17, 1981

[54] APPARATUS FOR DETERMINING THE REEVING OF A PULLEY SYSTEM

[75] Inventor: Bernard Fougea, Neuilly-sur-Seine, France

[73] Assignee: Coignet S.A., Paris, France

[21] Appl. No.: 28,321

[22] Filed: Apr. 9, 1979

[30] Foreign Application Priority Data

Apr. 12, 1978 [FR] France ..... 78 10826

[51] Int. Cl.[3] ..... B66C 23/60; B66D 1/36; B66D 1/54

[52] U.S. Cl. ..... 254/338; 254/266; 340/677

[58] Field of Search ..... 254/173 R, 173 A, 173 B, 254/172, 188, 189, 174, 175, 192, 190 R, 139, 145, 150 R, 186 R; 116/67 A, 68; 250/561, 571; 340/677, 679, 680, 686; 242/36, 49; 226/45, 100, 189

[56] References Cited

U.S. PATENT DOCUMENTS

| | | | |
|---|---|---|---|
| 3,345,812 | 10/1967 | Pickering | 250/561 X |
| 3,511,476 | 5/1970 | Horton | 254/173 R X |
| 3,843,883 | 10/1974 | DeVita | 340/677 X |
| 4,042,213 | 8/1977 | Schreyer | 254/174 X |
| 4,046,355 | 9/1977 | Martin | 254/173 R |
| 4,169,981 | 10/1979 | White et al. | 250/561 |

*Primary Examiner*—John M. Jillions
*Attorney, Agent, or Firm*—Diller, Ramik & Wight

[57] ABSTRACT

Apparatus for determining reeving of a pulley system including head pulleys on a jib or boom of a crane and reeving pulleys opposite the head pulleys. There is provided a sensor which may be electrically, mechanically, optically or pneumatically operable at some of the pulleys of the pulley system for sensing the presence or absence of the rope at its associated pulley. Each sensor provides a signal which is fed into a decoder module which may be connected to a display unit for displaying the information or a control device for enabling or inhibiting operation of the associated lifting equipment.

4 Claims, 5 Drawing Figures

APPARATUS FOR DETERMINING THE REEVING OF A PULLEY SYSTEM

FIELD OF THE INVENTION

The present invention relates to apparatus for determining the reeving of a pulley system for a jib or boom of a crane or other lifting equipment, and more particularly the number of reeving lines of the load-lifting rope reeved other various pulleys of the system.

It will be recalled, to refresh the reader's memory, that such a pulley system comprises a certain number n of so-called head pulleys opposite a certain number m of reeving pulleys and that the number of falls or reeving lines determines the actual load which may be applied to the fall connected to the associated hook, bucket, grap or other lifting attachment.

From the outset it will be specified that the invention is concerned precisely with operational safety based on accurate data relative to the state of the reeving pathway of the lifting rope.

BACKGROUND OF THE INVENTION

Various known apparatus exist for monitoring the condition or loading of lifting equipment. Such apparatus call for the use of certain physical or mechanical parameters such as the angle and the length of the jib or boom and the actual load while other more complex apparatus measure the load applied at the lifting attachment. Attendant data acquisition and handling enable compliance with the safety factor of the crane or other lifting equipment taken as a whole, (e.g. mechanical strength, overturning couple), but do not function with regard to the maximum permissible load on the load-lifting rope. One must clearly distinguish, however, between the rated load of the crane or other lifting equipment and that of the load-lifting rope which have entirely different values.

In association with certain systems there are manual switches which simulate the reeving as a function of the permissible load on the lifting attachment and the mechanical properties, namely strength, of the load-lifting rope. Still, such an arrangement obviously does not afford positive protection.

SUMMARY OF THE INVENTION

The object of the present invention is therefore to provide a simple, reliable and economical apparatus or arrangement for supplying positive information about the number of falls of rope or reeving lines, in directly usable form or for use in cooperation with other display or control systems.

According to the invention there is provided apparatus for determining the reeving of a pulley system associated with a boom or jib of lifting equipment comprising a number n of head pulleys adapted to cooperate with a number m of reeving pulleys by means of a rope attached at one of its ends to an anchoring point and wound at its other end around a hoist drum. The improvement comprises sensing means associated individually with at least some of said pulleys adapted to provide a signal in response to the presence or absence of the rope at their associated pulleys whereby the number of reeving lines may be determined.

Preferably there are also provided sensing means at the anchoring point.

It will be noted that the arrangement of the sensing means with the pulleys makes available, after processing the signals, reliable data as to the reeving pathway.

According to another feature of the invention more particularly concerned with a pulley system in which there is an idler pulley between the hoist drum and one of the head pulleys, other sensing means being provided for producing a signal acknowledging the presence or absence of the rope between the idler pulley and said one head pulley.

As will be seen below the data issued from the last-mentioned sensing means more specifically defines certain reeving.

It will be readily apparent that the sensing means may operate pneumatically, optically, mechanically or electrically, and each of these categories being taken in its widest sense to cover all allied technologies.

Advantageously the signals issued by the sensing means are in binary form. These signals are also easily decoded and processed for display or signaling or supplied to control means.

These and other features and advantages of the invention will be better understood from the description which follows, given by way of illustrative example, of an embodiment of the invention with reference to the accompanying drawings.

DETAILED DESCRIPTION OF THE PREFERRED EMBODIMENT

Figure 1:
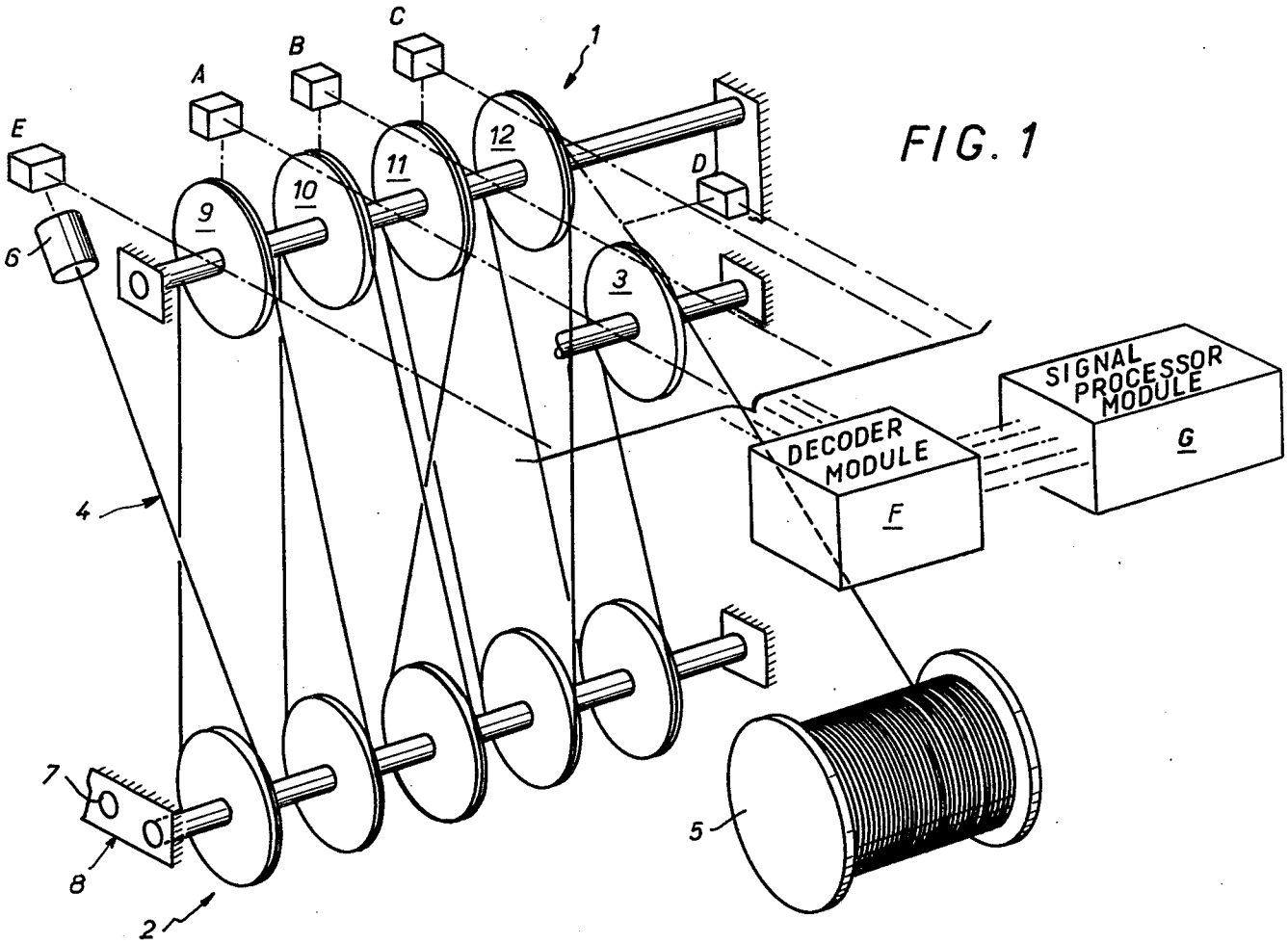
FIG. 1 is a schematic showing, in a perspective view, of a conventional pulley system illustrating the association of sensing and locating means at certain pulleys for ascertaining the reeving pathway of the traction rope over the pulleys.

Reference will first of all be made to FIG. 1 which represents a pulley system comprising a set of head pulleys 1 fixed to the boom or jib of a crane or other lifting equipment, a set of reeving pulleys 2, an idler pulley 3, which is optional, and a load-lifting or traction rope 4 for lifting a load by means of the pulley system. (The term "rope" is intended to cover all possible load-lifting elements irrespective of their nature). A hoist drum is shown at 5. The rope 4 is anchored at anchoring point or wedging block 6 fixed to the free end or head of the boom or jib. The lower anchoring point 7 is associated with the pulley block 8. Three sensing means or sensors A, B and C are respectively associated with head pulleys 9, 10 and 11. A sensing means or sensor D indicates the presence or absence of the rope 4 between the idler pulley 3 and the final pulley 12 of the set of head pulleys 1. A sensing means or sensor E is fitted at the upper anchoring point 6. A decoder module F decodes signals produced by the sensors A, B, C, D and E. A signal processor module G processes the signals responsive to the presence or absence of the rope at various locations along the pulley system supplied by the decoder module.

FIGS. 2, 3, 4 and 5 respectively show pulley systems having two, three, nine and ten reeving lines or falls of rope.

For the sake of simplicity FIGS. 2–5 do not represent the head of the boom or jib on which the set of head pulleys 1 are mounted, the anchoring point 6 or the lifting attachment connected to the end of the rope. These features are well known to those skilled in the art.

Irrespective of the operating principle of the sensing means (mechanical, pneumatic, optical, or electrical) they may be adapted to generate state signals corresponding to the presence or absence of the load-lifting rope. These signals may therefore be in binary form with states 0 and 1 defining, for example, the absence and presence, respectively, of the traction rope.

Figure 2:
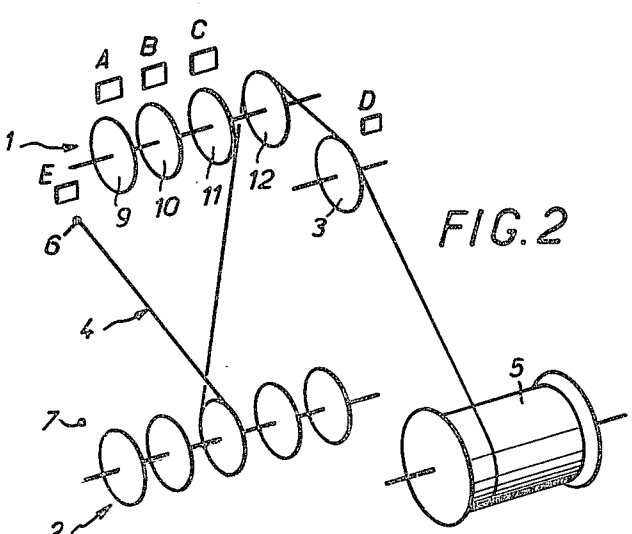

The application of this arrangement to the reeving in FIG. 2 is tabulated below:

| | |
|---|---|
| sensor A | state 0 |
| sensor B | state 0 |
| sensor C | state 0 |
| sensor D | state 1 |
| sensor E | state 1 |

The signal applied to the decoder module will therefore be in the form 00011.

Figure 3:
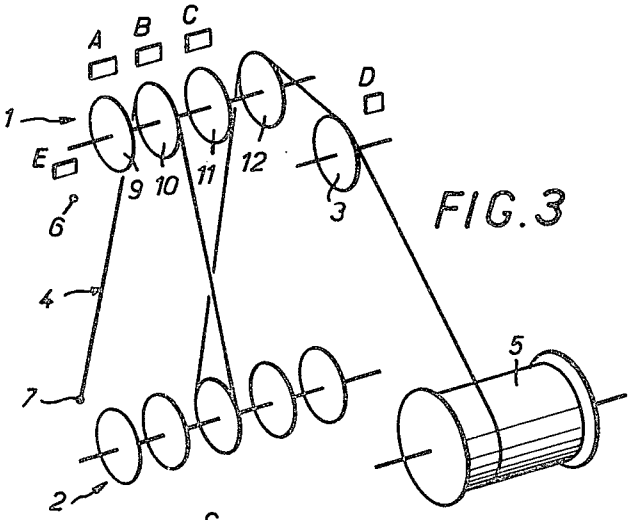
FIGS. 2, 3, 4 and 5 illustrate the application of the apparatus of FIG. 1 to reevings with two, three, nine and ten falls of rope, respectively.
Figure 5:
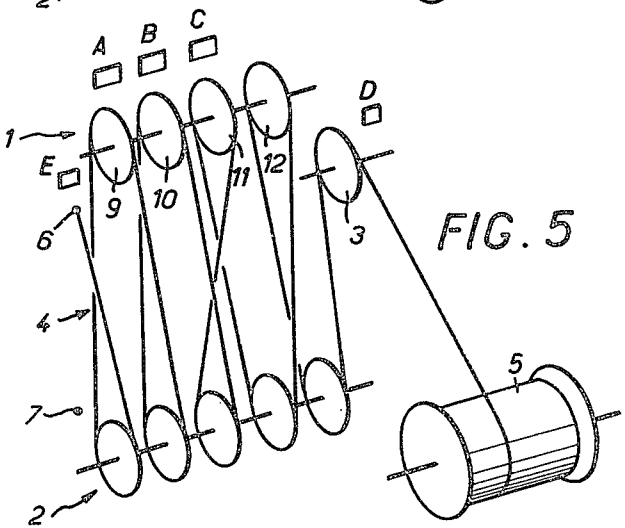
Figure 4:
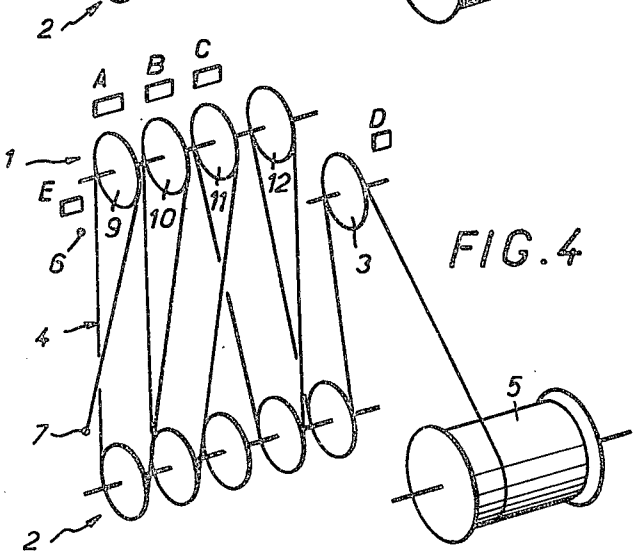

FIGS. 3, 4 and 5 in turn yield the following signals:

| | |
|---|---|
| FIG. 3 | 01010 |
| FIG. 4 | 11100 |
| FIG. 5 | 11101 |

After decoding the supplied signals provide the following information:

| | |
|---|---|
| 00011 | two-line reeving |
| 01010 | three-line reeving |
| 11100 | nine-line reeving |
| 11101 | ten-line reeving |

Similarly, the following binary numbers designate other reevings as follows:

| | |
|---|---|
| 01011 | four-line reeving |
| 01110 | five-line reeving |
| 11111 | eight-line reeving |

It will be immediately understood that for reasons of data handling certain rules hold, for example:

signals supplied ending in 1 mean as even number of lines;

signals supplied ending in 0 mean an odd number of lines;

signals starting with a 1 mean a number of lines greater than 8.

The load on the load-lifting rope being limited by the mechanical properties of the rope, the permissible load reeved is a function of the number of lines of reeving or falls. It will be appreciated therefore that the present apparatus provides, in situ or remotely, accurate information which is immediately processable.

As each complex signal is in logic the present invention offers from the safety standpoint an extremely important advantage: all signals defining a complex signal not in conformity with the logic of the system may be interpreted in the least favorable light from the viewpoint of permissible load. Overloading of the load-lifting rope is therefore virtually eliminated.

The actual construction of the sensors or sensing means will not be considered here in detail. There are numerous variations well known to those skilled in the art and they may be actuated automatically or manually if necessary. As pointed out above the overall decoded information on the reeving pathway may be supplied to a signalling or display system or a control means for the load lifted upon the command of the lifting equipment to enable it or inhibit it.

This information may also be previously stored to be compared with set values.

It will be understood that the present invention admits of manifold variations and modifications without departing from the scope of the accompanying claims.

What is claimed is:

1. In a pulley system for a jib or boom of load lifting equipment including a set of head pulleys fixed to the jib or boom and a set of cooperable reeving pulleys, and a rope reeving at least some of the head and reeving pulleys so as to define a reeving pathway which corresponds to the lift load and rope load, the rope being attached at one end to an anchoring point and wound at its other end around a hoist drum, the improvement comprising sensing means operatively associated with at least some of said head pulleys for sensing the presence or absence of the rope at said associated pulley and for delivering a signal having one of two states, a first said state corresponding to the presence of the rope at said associated pulley and a second said state corresponding to the absence of the rope at said associated pulley, decoding means coupled to said sensing means for receiving said signal from each of said sensing means and delivering a complex digital signal representative of the actual reeving pathway for comparison with a predetermined reeving pathway.

2. The improvement according to claim 1, said one end of said rope being attached to one of two anchoring points respectively located at the head pulley block and the reeving pulley block, further comprising additional sensing means operatively associated with one of said anchoring points for delivering to said decoding means a signal having one of two states, a first of said states corresponding to the presence of said rope end at one of said anchoring points and a second of said states corresponding to the absence of said rope end at said one anchoring point.

3. The improvement according to claim 2, an idler pulley being provided between said hoist drum and a first said head pulley, further comprising other sensing means located between said idler pulley and said first head pulley responsive to the presence of said rope in a path from said idler pulley to said first head pulley for delivering a signal having one of two states, a first of said states corresponding to the presence of said rope in the path between said idler pulley and said first head pulley and a second of said states corresponding to the absence of said rope in the path between said idler pulley and said first head pulley.

4. In a pulley system for a jib or boom of load lifting equipment including a set of head pulleys fixed to the jib or boom and a set of cooperable reeving pulleys, and a rope receiving at least some of the head and reeving pulleys so as to define a reeving pathway which corresponds to the lift load and rope load, the rope being attached at one end to one of at least two anchoring points and wound at its other end around a hoist drum, the improvement comprising sensing means for sensing the presence or absence of the rope at at least selected ones of said head pulleys and for sensing the presence or absence of the one end of the rope at the one of the at least two anchoring points, and decoding means responsive to said sensing means for generating an output signal representative of the actual receiving pathway defined by the rope.

* * * * *